US005236748A

United States Patent [19]

Cheng

[11] Patent Number: 5,236,748

[45] Date of Patent: Aug. 17, 1993

[54] WRINKLED PAPER FLOWER DECORATION AND METHOD

[76] Inventor: Peter S. C. Cheng, 5 Ross Street, Toronto, Ontario, Canada, M5T 1Z8

[21] Appl. No.: 876,470

[22] Filed: Apr. 30, 1992

[51] Int. Cl.[5] ..... A41G 1/00

[52] U.S. Cl. ..... 428/26; 156/61

[58] Field of Search ..... 428/24, 25, 26, 7; 156/61

[56] References Cited

U.S. PATENT DOCUMENTS

| | | | |
|---|---|---|---|
| 921,246 | 5/1909 | Haskins | 428/26 |
| 1,418,846 | 6/1922 | Stevens | 428/26 |
| 1,568,859 | 1/1926 | Rosas | 428/26 |
| 3,146,153 | 8/1964 | Stein | 428/26 |
| 3,822,171 | 7/1974 | Bouillot | 428/25 |
| 4,215,462 | 8/1980 | Fernandez | 428/24 X |
| 4,708,892 | 11/1987 | Young et al. | 428/24 |
| 4,963,411 | 10/1990 | Protz, Jr. | 428/152 X |

*Primary Examiner*—Henry F. Epstein

*Attorney, Agent, or Firm*—Kirschstein, Ottinger, Israel & Schiffmiller

[57] ABSTRACT

A wrinkled paper decoration is made by jointly coiling an elongated paper strip to which a bendable wire is attached in a continuous spiral. The coiled wire is bent, and the paper strip is simultaneously wrinkled. The bent wire retains the paper strip in a wrinkled configuration.

17 Claims, 3 Drawing Sheets

10
12
14
16
18
20
22, 24
26
32
34
36
38
40
42
44
46
48
3

7
7

WRINKLED PAPER FLOWER DECORATION AND METHOD

BACKGROUND OF THE INVENTION

1. Field of the Invention

This invention generally relates to an artificial flower decoration for adorning an object such as a gift package and, more particularly, to a method of making a wrinkled flower decoration starting from a planar paper sheet.

2. Description of the Related Art

It is known to make artificial flowers from rigid, molded plastic and ceramic materials having smooth outer surfaces. It is also known to produce artificial flowers from non-rigid materials such as ribbon or stretch fabric, also having smooth outer surfaces. Bendable wires are usually attached to the non-rigid materials and, after being bent, the wires support the non-rigid materials in a desired flower configuration. See, for example, U.S. Pat. Nos. 921,246; 1,418,846; 1,568,859; 3,822,171; 4,215,462; and 4,708,892.

It is also known to fold paper along straight folding lines to make a folded flower with an angular appearance. While such artificial flowers of folded paper, molded rigid materials and supported non-rigid materials are often attractive, they do not have a wrinkled, crumpled outer appearance and, hence, are not so visually interesting and do not realistically simulate certain flowers.

SUMMARY OF THE INVENTION

Objects of the Invention

It is a general object of this invention to make a wrinkled paper flower decoration for adorning an object such as a gift package.

Another object of this invention is to make a wrinkled flower decoration from a flat paper sheet.

Another object of this invention is to provide a novel method of making an artificial wrinkled paper flower decoration.

Features of the Invention

In keeping with these objects and others which will become apparent hereinafter, one feature of this invention resides, briefly stated, in a wrinkled paper flower decoration and a method of making the same.

An elongated paper strip is formed with opposite strip end regions spaced apart of each other along a longitudinal direction. An elongated, bendable, shape-retaining element, e.g., wire, is attached lengthwise along the longitudinal direction to and along the paper strip.

The paper strip and the attached element are jointly coiled in a continuous spiral coil from one to the other of the strip end regions about a coiling axis that extends along a transverse direction generally perpendicular to the longitudinal direction. The coil has opposite coil end regions spaced apart along the transverse direction.

One of the coil end regions that is spaced away from the coiled element is thereupon gathered, preferably by being tied together. The coiled element is thereupon bent and, simultaneously, the paper strip is wrinkled to a wrinkled configuration. The bent coiled element retains the paper strip in the wrinkled configuration.

In a preferred construction, the strip has a pair of planar strip portions at either side of a centerline. The strip portions are folded about the centerline and adhered together. In a first embodiment, the wire is adhered at and along the centerline prior to folding the strip portions. In a second embodiment, the wire is adhered at and along an offset line traversely spaced from, and lying nearly parallel to, the centerline prior to folding. Preferably, the offset line extends at an angle of 5°–10° relative to the centerline.

A scalloped edge portion may be cut in a marginal edge region of the adhered strip portions. The scalloped edge portion is thereupon folded out of its common plane with the strip portions to form simulated petals extending generally radially of the coiling axis.

In still another construction, the wire is adhered near a marginal edge region at and along a first offset line that is transversely spaced from, and lying generally parallel to, a second offset line. The marginal edge region is initially folded about the first offset line and adhered to the strip, and thereupon, the marginal edge region together with the wire is folded about the second offset line and adhered to the strip. The upper portion of the strip to which th wire is attached between the offset lines has a multiple strip thickness, whereas the lower portion of the strip, has a single thickness.

A scalloped edge portion may be cut in the thicker upper strip portion between the offset lines to simulate petals. The single thickness lower strip portion may also be cut in the shape of a sawtooth triangular edge to prevent excessive bunching when the lower strip portion is thereafter gathered.

Prior to coiling the strip and the attached element into the continuous spiral coil, the joints between at least some of the simulated petals are folded over onto themselves in a zig-zag pattern. This increases the three-dimensional appearance of the flower.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figures 1, 2, 3, 4:
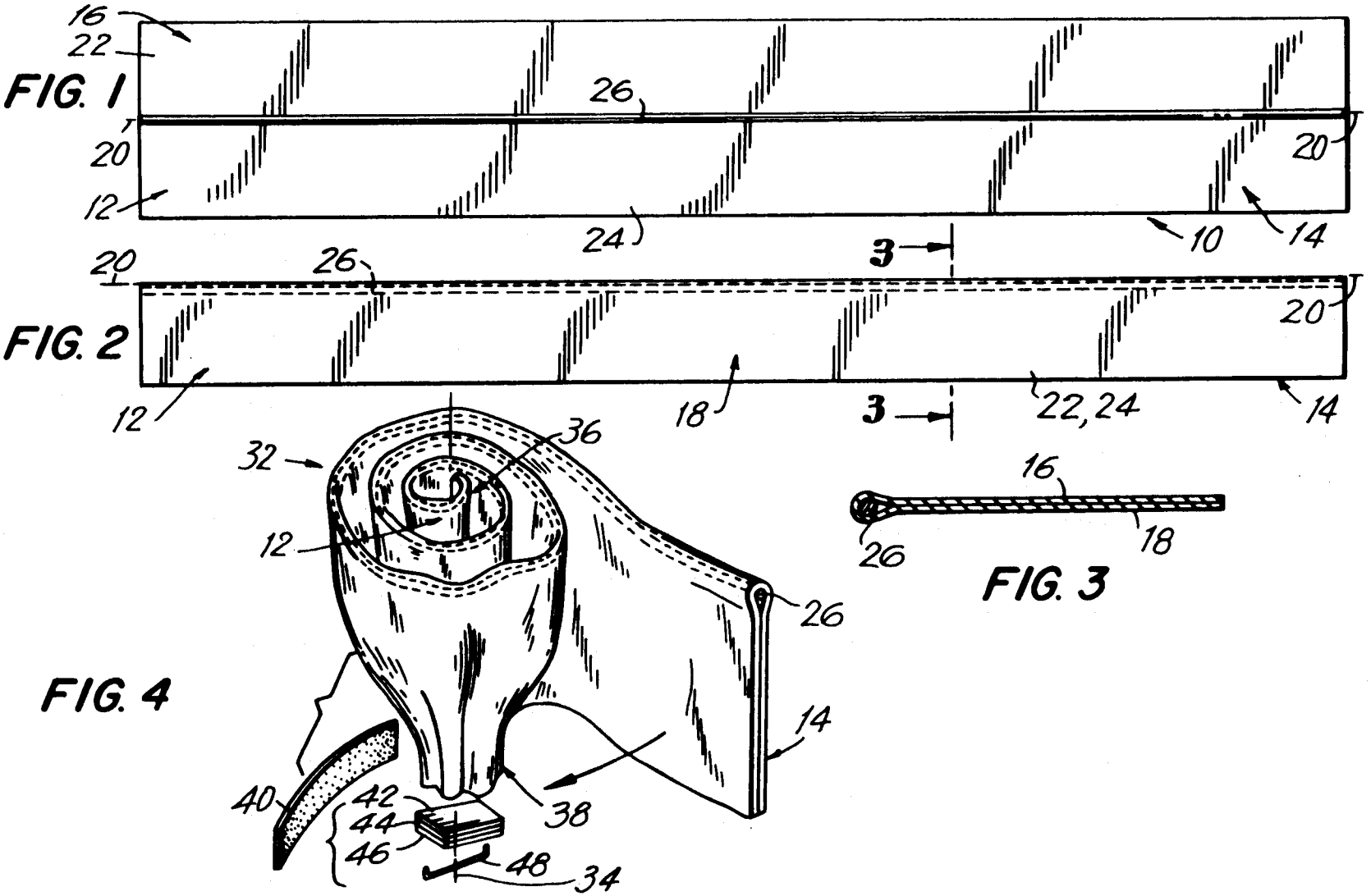
FIG. 1 is a top plan view of a planar paper sheet with an attached bendable wire at one stage of making a first embodiment of a wrinkled paper decoration according to this invention.
FIG. 2 is a top plan view of the sheet of FIG. 1 after being folded.
FIG. 3 is a broken-away, sectional view taken on line 3—3 of FIG. 2.
FIG. 4 is a broken-away, exploded, perspective view o the coiled sheet according to the first embodiment at a later stage of the method.

Referring now to the drawings, FIGS. 1–4 depict a first embodiment, FIGS. 5–8 depict a second embodiment, and FIGS. 9–13 depict a third embodiment, of a wrinkled paper decoration and method of making the same. In each embodiment, a rectangular planar paper strip 10 is provided. The strip 10 is elongated and extends between opposite strip end regions 12, 14 along a longitudinal direction. The strip 10 has a pair of planar strip portions 16, 18 at either side of a centerline 20. Strip portions 16,18 have longitudinally-extending marginal regions 22, 24 spaced apart along a transverse direction generally perpendicular to the longitudinal direction.

An elongated, bendable, shape-retaining element, e.g., a metal ductile wire 26 of thin gauge, is attached with adhesive lengthwise along the longitudinal direction to and along the paper strip. In the first embodiment, the wire 26 is glued at and along the centerline 20. In the second embodiment, the wire 26 is glued at and along an offset line 28 which is transversely spaced from, and nearly parallel to, the centerline 20. Preferably, the wire 26 extends at an acute angle of 5°–10° relative to the centerline. In the third embodiment, the wire 26 is glued at and along a first offset line 28 which is transversely spaced from, and generally parallel to, a second offset line 50. The offset lines 28, 50 are spaced from the centerline 20.

Figures 5, 6, 7, 8:
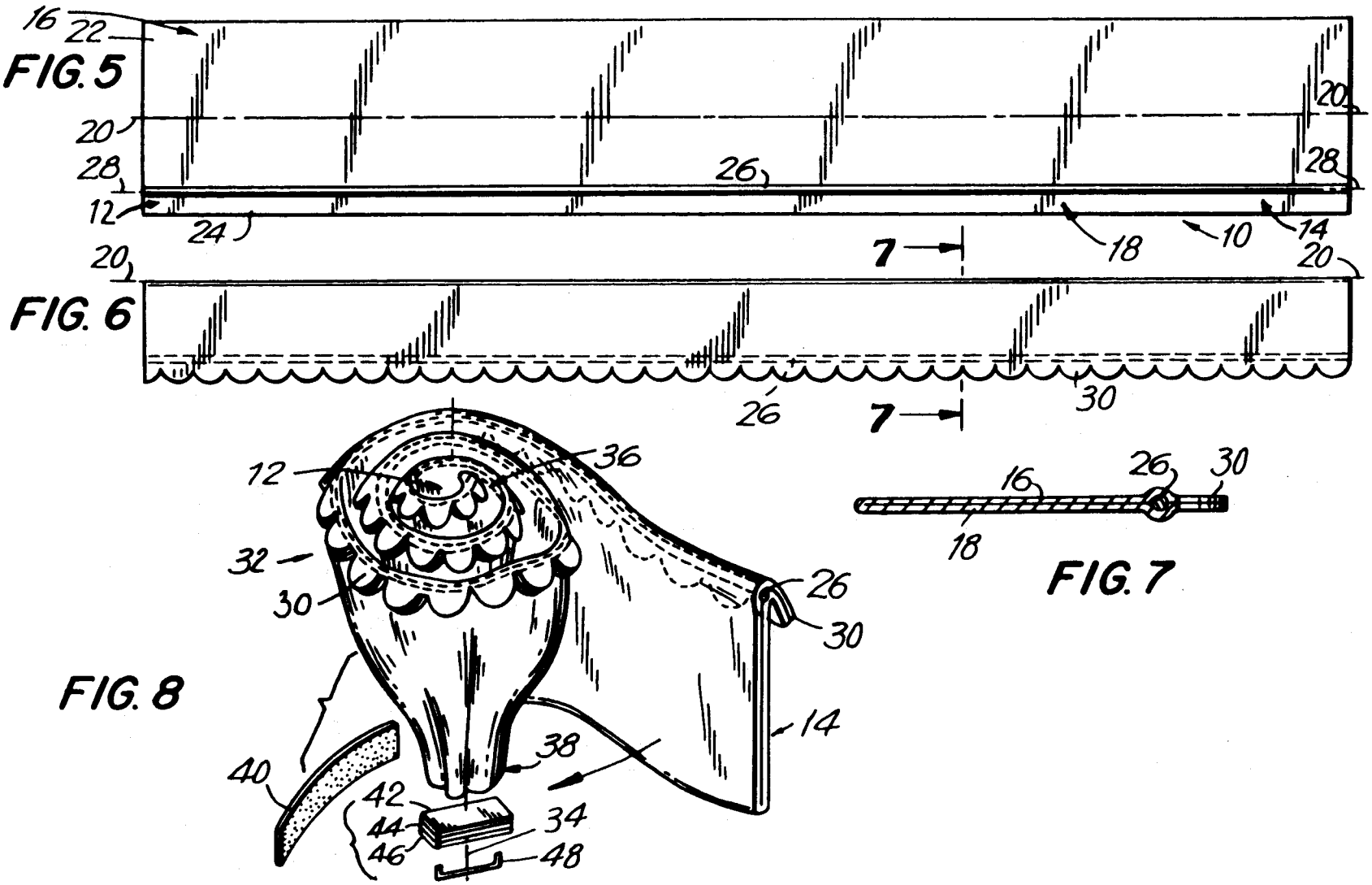
FIG. 5 is a top plan view analogous to FIG. 1 but of a second embodiment of a wrinkled paper decoration.
FIG. 6 is a top plan view analogous to FIG. 2 but of the second embodiment.
FIG. 7 is a sectional view taken on line 7—7 of FIG. 6.
FIG. 8 is a view analogous to FIG. 4 but of the second embodiment.

In the first and second embodiments, the strip portions 16,18 are folded about the centerline 20 an adhered to each other by the prior application of an adhesive layer. As shown in FIGS. 3 and 7, the wire 26 is sandwiched between the strip portions 16, 18.

Figures 9, 10, 11, 12, 13:
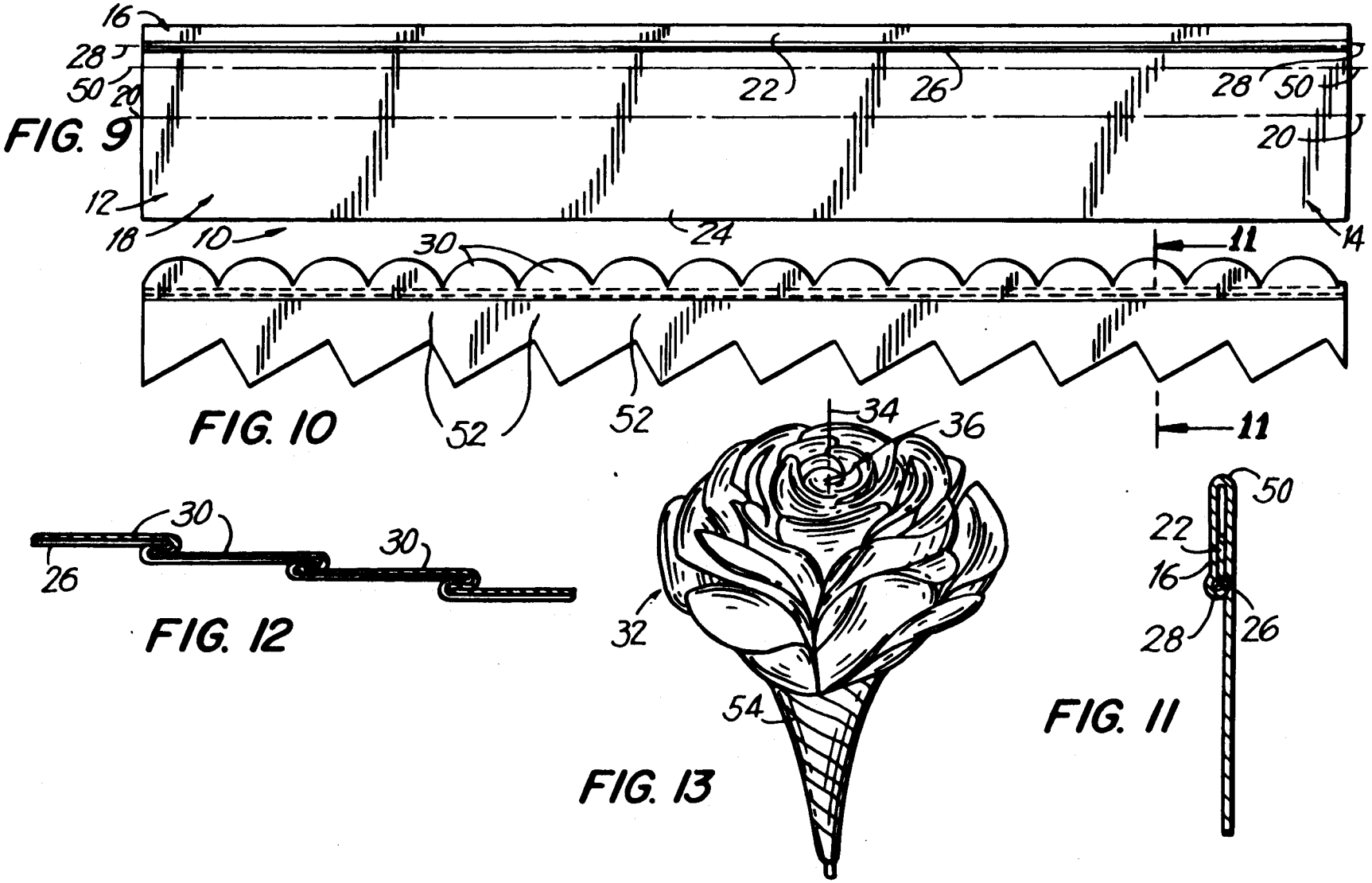
FIG. 9 is a top plan view analogous to FIG.1 but of a third embodiment of a wrinkled paper decoration.
FIG. 10 is a top plan view analogous to FIG. 2 but of the third embodiment.
FIG. 11 is a sectional enlarged view taken on line 11—11 of FIG. 10.
FIG. 12 is a broken-away, top plan view of a portion of the third embodiment.
FIG. 13 is a perspective view of the third embodiment.

In the third embodiment, upper marginal region 22 is folded about the first offset line 28 and adhered with adhesive to the upper strip portion 16. Thereupon, the upper marginal region 22 with the attached wire 26 is folded about the second offset line 50 and adhered with adhesive to the remaining upper strip portion 16. As shown in FIG. 11, the wire 26 is sandwiched between multiple sheet layers, while the remainder of the strip is a single sheet layer.

In the first embodiment, the overlapping marginal edge regions 22, 24 extend along a linear outer edge. In the second embodiment, the overlapping marginal edge regions 22, 24 are cut to form a scalloped edge having individual scallops or petals 30.

In the third embodiment, the multi-layered portion of th strip above the wire 26 is cut to form a scalloped edge having individual scallops or petals 30. The marginal edge region 24 below the wire 26 is also cut in a sawtooth pattern. Cutting is advantageously effected by placing the marginal edge regions 22, 24 in a die stamping machine.

Thereafter, the paper strip and the attached wire are jointly rolled and coiled in a continuous spiral coil 32 from one 12 to the other 14 of the strip end regions about a coiling axis 34 that extends along the transverse direction. The convolutions of the spiral grow in diameter from the coiling axis 34 in a radially outward direction. The coil 34 has an upper coil end region 36 at which the wire 26 is proximally located, and a lower coil end region 38 spaced remotely away from the wire 26.

In the third embodiment, prior to coiling, the wire 26 is folded onto itself in a zig-zag configuration at some of the joint regions 52 between the petals 30. As best seen in FIG. 12, the wire 26 at selected joint regions 52 are bent and maintained in a Z-shape. This increases the radial distance between petals and enhances the overall flower simulation.

Thereupon, the lower coil end region 38 is gathered either by a binding loop or collar 40 or by a tape 54. The collar may be a circumferentially-complete ring or a split ring, or preferably, a rope that is tied completely around the coil end region 38.

In the first and second embodiments, a backing card 42, a pressure-sensitive adhesive layer 44 applied over the undersurface of the card 42, and a peel-off tab 46 applied over the adhesive layer 44 are attached to the lower coil end region 38 by means of a staple 48. In the third embodiment, the flower is a corsage and may be pinned to an article of clothing.

The coiled wire 26 is bent, as desired, preferably into an undulating, sinuous shape. Simultaneously, the coiled paper strip is wrinkled as desired, preferably by being crumpled and creased with an uneven outer surface. The wrinkling is advantageously effected by finger pressure.

As previously described, the wire 26, in the first embodiment, is located at the outermost end face of the upper coil end region 36, whereas in the second and third embodiments, the wire 26 is remotely spaced from the outermost end face of the coil end region 36. In the second and third embodiments, the petals 30 are folded about the wire 26 out of the plane previously shared with the planar strip portions 16, 18. The petals 30 have portions that extend radially of the coiling axis 34 and preferably are folded downwardly toward the lower coil end region 38. The resultant wrinkled artificial flower resembles a rose.

Once formed, the wrinkled paper decoration is conveniently secured to an object such as a gift package by peeling the tab 46 off the adhesive layer 44, thereby exposing the same. It is merely necessary now to press the exposed adhesive layer against the object to adhere the decoration thereto. The decoration may also be pinned to clothing.

The wire 26 may be omitted, but this is not preferred.

Strip 10 may include a plurality of separate sheets glued together.

It will be understood that each of the elements described above, or two or more together, also may find a useful application in other types of constructions differing from the types described above.

While the invention has been illustrated and described as embodied in a wrinkled paper flower decoration and method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A wrinkled paper decoration, comprising:

(a) an elongated wrinkled paper strip extending along and between oposite strip end regions:

(b) an elongated, bent element fixedly adhered lengthwise to and along the wrinkled paper strip between folded-over portions of the strip that are fixedly adhered together, said element being operative for supporting the strip in a wrinkled confirguation:

(c) said wrinkled paper strip and adhered bent element being jointly coiled in a continuous spiral coil from one to the other of the strip end regions about a coiling axis, said coil having opposite coil end regions spaced apart along the coiling axis; and (d) holder means for gathering one of the coil end regions of the wrinkled paper strip located remotely from the attached element.

2. Decoration according to claim 1, wherein the folded-over portions of the strip are planar and are folded onto each other about a centerline and glued to each other in a common plane, and wherein the element is glued to and along the centerline.

3. Decoration according to claim 1, wherein the folded-over portions of the strip are planar and are folded onto each other about a centerline and glued to each other in a common plane, and wherein the element is glued to and along an offset line spaced away, and lying sustantially parallel to, the centerline.

4. Decoration according to claim 3, wherein the adhered strip portions have a scalloped edge portion folded out of the common plane.

5. Decoration according to claim 1, wherein the element is glued to and along a first offset line spaced away, and lying substantially parallel to, a second offset line, and wherein the strip portions are planar and are folded onto, and glued to, each other about each offset line.

6. Decoration according to claim 5, wherein the folded planar strip portions between the offset lines have a series of simulated cut petals interconnected by joints.

7. Decoration according to claim 5, wherein the element has a zig-zag shape at a plurality of the joints.

8. Method of making a wrinkled paper decoration, comprising the steps of:

(a) forming an elongated paper strip with opposite strip end regions spaced apart of each other along a longitudinal direction;

(b) fixedly adhering an elongated, bendable, shape-retaining element lengthwise along the longitudinal direction to and along the paper strip;

(c) folding a portion of the strip over the element onto another portion of the strip;

(d) fixedly adhering the strip portions to each other;

(e) jointly coiling the paper strip and the element in a continuous spiral coil from one to the other of the strip end regions about a coiling axis that extends along a transverse direction generally perpendicular to the longitudinal direction, said coil having opposit coil end regions spaced apart along the transverse direction;

(f) gathering one of the coil end regions spaced away from the coiled element; and (g) bending the coiled element and simultaneously wrinkling the paper strip to a wrinkled configuration, said bent coiled element retaining the paper strip in the wrinkled configuration.

9. Method according to claim 8, wherein the strip portions are planar and are located at either side of a centerline, and wherein step (b) is performed by adhering the element on and along the centerline; and wherein step (c) is performed by folding the strip portions about the centerline; and wherein step (d) is performed by adhering the strip portions together in a common plane.

10. Method according to claim 8, wherein the strip portions are planar and are located at either side of a centerline, and wherein step (b) is performed by adhering the element on and along an offset line spaced along the transverse direction from, and substantially parallel to, the centerline; and wherein step (c) is performed by folding the strip portions about the centerline; and wherein stp (d) is performed by adhering the strip portions together in a common plane.

11. Method according to claim 10; and further comprising the steps of cutting a scalloped edge portion in the adhered strip portions and folding the scalloped edge portion out of the common plane with the adhered strip portions.

12. Method according to claim 8, wherein step (b) is performed by adhering the element on and along a first offset line spaced along the transverse direction, and substantially parallel to, a second offset line; and wherein step (c) is performed by folding a first marginal edge region about the first offset line onto the strip and, thereupon, folding the first marginal edge region with the adhered element about the second offset line onto the strip, and adhering the folded-over regions between the offset lines together.

13. Method according to claim 12; and further comprising the steps of cutting a scalloped edge portion in the adhered folded-over regions between the offset lines.

14. Method according to claim 13, wherein the cutting step includes forming a series of simulated petals interconnected at joints; and further comprising the step of deforming the element at a plurality of said joints prior to performing the coiling step.

15. Method according to claim 14, wherein the deforming step is performed by bending the element into a zig-zag shape at the plurality of said joints.

16. Method according to claim 8; and further comprising the step of securing the decoration to an object.

17. Method according to claim 8, wherein the forming step is performed by forming the paper strip of a plurality of sheets.

* * * * *